US005477641A

United States Patent [19]

Heckel et al.

[11] Patent Number: 5,477,641

[45] Date of Patent: Dec. 26, 1995

[54] SAFETY DEVICE FOR A VEHICLE ELECTRIC WINDOW LIFTER WITH A CABLE

[75] Inventors: Robert J. Heckel, Cormeilles; Enrico Fin, Paris; Achim R. Gier, Garches; Pascal Bonduel, Sully S/Loire, all of France

[73] Assignee: Rockwell Body and Chassis Systems, France

[21] Appl. No.: 87,833

[22] Filed: Jul. 2, 1993

[30] Foreign Application Priority Data

Jul. 10, 1992 [FR] France ..... 92 08622

[51] Int. Cl.[6] ..... E05F 15/02

[52] U.S. Cl. ..... 49/28; 49/352

[58] Field of Search ..... 49/26, 28, 31, 49/348, 349, 352

[56] References Cited

U.S. PATENT DOCUMENTS

| | | | |
|---|---|---|---|
| 1,978,126 | 10/1934 | Blodgett | 49/26 X |
| 3,012,520 | 12/1961 | Curtis | 49/26 X |
| 3,022,064 | 2/1962 | Russell | 49/26 |
| 3,160,408 | 12/1964 | Woods | 49/26 |
| 3,224,493 | 12/1965 | Hoyk | 49/26 X |
| 4,803,807 | 2/1989 | Stockermann et al. | 49/26 |
| 4,970,827 | 11/1990 | Djordjevic | 49/352 X |
| 5,074,077 | 12/1991 | Toyoshima et al. | 49/352 |

FOREIGN PATENT DOCUMENTS

| | | |
|---|---|---|
| 0107531 | 5/1984 | European Pat. Off. . |
| 1244609 | 7/1976 | Germany . |
| 2644213 | 4/1978 | Germany . |
| 1184645 | 3/1970 | United Kingdom . |
| 2188673 | 10/1987 | United Kingdom . |

*Primary Examiner*—Peter M. Cuomo
*Assistant Examiner*—Jerey Redman

[57] ABSTRACT

This safety device for electric window lifters of the Bowden cable (3) type comprises electromechanical means for detecting and measuring the force exerted on the cable (3); a compression spring (11), housed in a sheath (9) coaxial to the cable (3) bears, on the one hand, on a stationary support (8) and, on the other hand, on a tubular component (12) mounted so as to slide inside the sheath (9) and carrying a tab (13) which interacts with an electric switch (14) forming part of an electric circuit for controlling the motor capable of automatically reversing the direction of rotation of the motor when the force (F) exerted on the window and the cable (3) gives rise to a movement of the tubular component (12), which opens the switch (14). This electromechanical safety device is of simple and inexpensive construction.

4 Claims, 1 Drawing Sheet

SAFETY DEVICE FOR A VEHICLE ELECTRIC WINDOW LIFTER WITH A CABLE

BACKGROUND OF THE INVENTION

1. Field of the Invention

The subject of the present invention is a safety device for vehicle electric window lifters of the type having a cable for driving the window using a motor, the cable passing around a return pulley.

2. Description of the Related Art

It is known that there currently exist three types of window lifter on motor vehicles: cable back window lifters, twisted cable (Bowden cable) window lifters, and arm and toothed sector window lifters. The invention relates to the first two types of window lifter.

When an obstacle is located in the path for closing the window, the system must recognise the presence of an abnormal phenomenon and, if the force on the window exceeds a limiting value, the window must not continue its journey, but stop and at least release the force. This release of the force may be obtained either by releasing the window which descends under a small force or under the effect of its own weight if the friction of the lateral seal allows it, or by reversing the movement of the window which is then forced to descend.

In order to solve this problem various electrical and electromechanical safety devices have already been proposed which exhibit, amongst other drawbacks, the drawback of being relatively costly due to their complexity. This high manufacturing cost is obviously an obstacle to their widespread distribution.

SUMMARY OF THE INVENTION

The object of the invention is to provide an electromechanical safety device for cable window lifters which is simple to manufacture and consequently inexpensive.

According to the invention, the safety device comprises electromechanical means for detecting and measuring force exerted on the window and transmitted to the cable, such that they automatically reverse the direction of rotation of the motor when this force exceeds a predetermined limiting value.

According to one embodiment of the invention the said means comprise a compression spring, on the one hand bearing on a stationary support and, on the other hand bearing on an element capable of being moved by the cable by friction against the latter and counter to the return force of the spring, an electric switch interacting with the said element so as to be able to assume a first state when the force for driving the said element using the cable remains below the said predetermined value, and to assume a second state when this drive force exceeds the said predetermined value.

The electric switch forms part of a circuit for powering and controlling the motor, capable of reversing its direction of rotation in a way known per se.

Such a safety device is of relatively simple construction and is consequently inexpensive.

The invention will now be described with reference to the appended drawing which illustrates two embodiments thereof by way of non-limiting examples.

DESCRIPTION OF THE PREFERRED EMBODIMENTS

Figure 1:
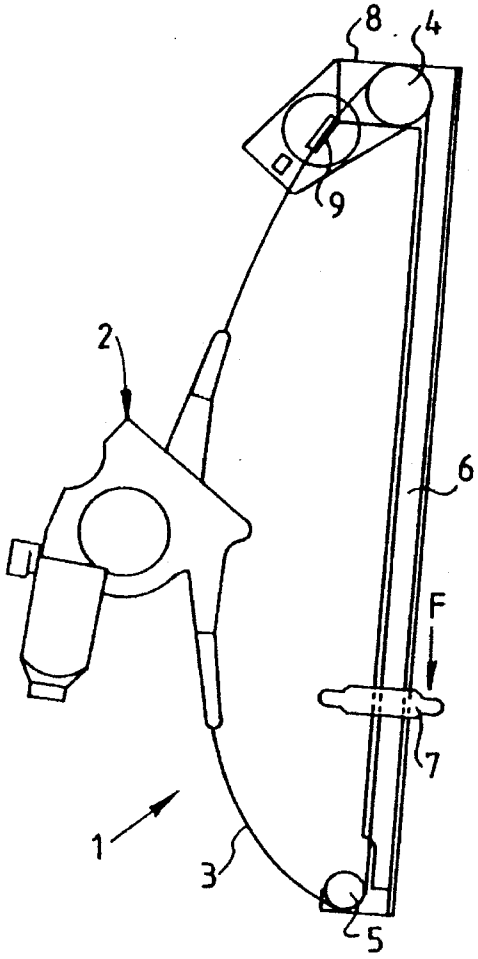
FIG. 1 is a partial diagrammatic elevation view of a twisted cable or Bowden cable electric window lifter equipped with a safety device according to a first embodiment of the invention.

The window lifter 1 represented in FIG. 1 comprises a motorized reduction gear 2 for driving a twisted cable or Bowden cable 3 passing around two return pulleys 4, 5. The strand of the cable 3 located between these two pulleys extends along a guide rail 6 and carries a carriage 7 which supports the window 22.

The upper pulley 4 is mounted on a stationary plate 8 on which there is fixed a sheath 9 extending over a suitable length around the cable 3. Inside the sheath 9 there is arranged a helical spring 11 coaxial with the cable 3, one end of which bears on the stationary plate 8 and the opposite end of which bears on an element 12 capable of being moved by the cable 3 by friction against the latter, counter to the return force of the spring 11. In the example described, this element 12 is a tubular component capable of sliding inside the sheath 9, coaxial with the cable 3 and provided with a lateral tab 13 interacting with the contact of an electric switch 14 mounted on a stationary support 15, such as the door panel (not represented).

Since the spring 11 acts by compression with a predetermined prestress, the operation of this safety feature is as follows: for as long as the force which the cable 3 is to transmit to the carriage 7 and to the window so as to raise the latter does not exceed a predetermined value, corresponding to the prestress force of the spring 11, the spring holds the tubular component 12 in a position such that its tab 13 actuates the electrical switch 14. If, on the other hand, following interposition of an obstacle on the path for closing the window the force F which the cable 3 is to transmit exceeds the limit fixed by the prestress of the spring 11, the tubular component 12 slides in the sheath 9 counter to the return force of the spring 11 which is thus compressed. As a consequence, this movement separates the component 12 and the tab 13 of the switch 14 which is no longer actuated. This change in state of the switch triggers a command for reversing the direction of rotation of the motor of the motorised reduction gear 2 via the electric supply circuit of the latter, of which the electrical switch 14 forms a part.

This type of safety device requires an electric circuit with electrical memory because it returns almost immediately to its starting position after detecting and reversing the direction of movement.

Figure 3:
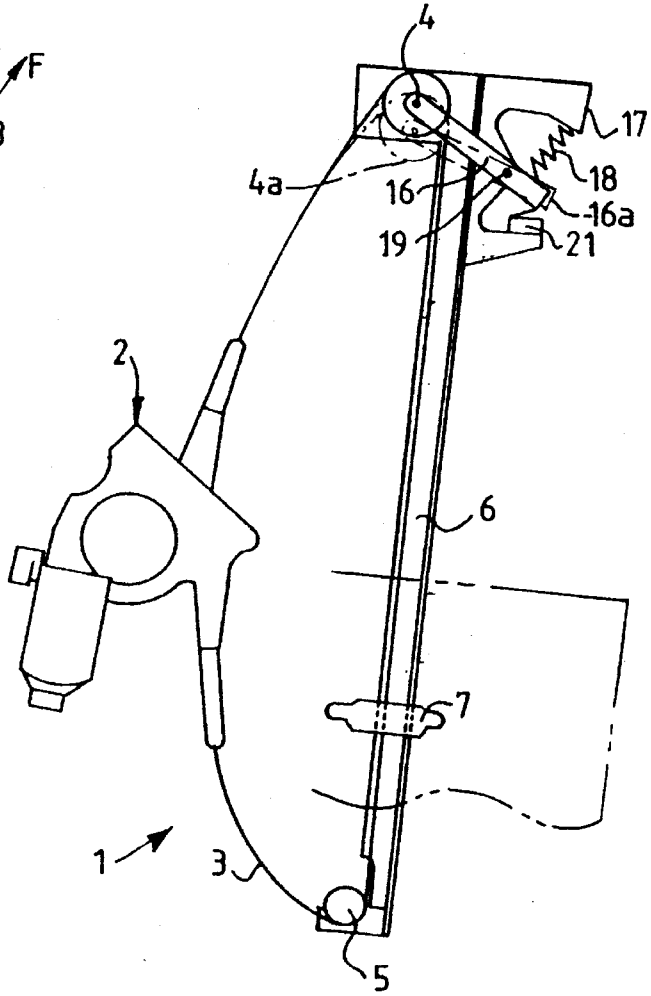
FIG. 3 is a view similar to FIG. 1 illustrating a second embodiment of the safety feature according to the invention.

In the embodiment represented in FIG. 3, the invention is also applied to a window lifter 1 of the twisted cable type 3, but the latter is modified in the following way. The upper pulley 4 is mounted at the end of a lever 16 which is articulated about a spindle 19 onto a stationary member, namely, in the example represented, the door panel 17. The electromechanical means of the safety feature according to the invention also comprise elastic means for holding the lever 6 and the pulley 4 in a specified angular position. These means are made up, in the example described, of a compression spring 18 one end of which is fixed to the lever 16 and the other end of which is fixed to the panel 17. The spring 18 acts on the part of the lever 16 located on the side of the spindle 19 opposite the pulley 4.

Figure 2:
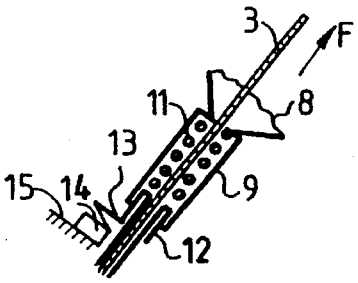
FIG. 2 is a partial half-elevation half-section view on a larger scale showing the safety device of FIG. 1.

The electromechanical safety feature according to the invention finally includes an electric switch 21 fixed for example to the support 17 and positioned so as to be able to interact with the end of the lever 16 opposite the pulley 4. The switch 21 forms part of a control circuit known per se, not represented, with an electrical memory like the one associated with the safety feature of FIGS. 1 and 2. It interacts with the lever 16 so as to be in a first state when it is actuated for as long as the lever 16 and the pulley 4 remain in an angular position determined by the compression force of the spring 18 which exerts on the lever 16 a force tending to keep the pulley 4 in the high position and the cable 3 tensioned. The switch 21 passes into a second state when it is no longer actuated due to the fact that the lever 16 as well as the pulley 4 tilt under the effect of a force exerted on the window, which force exceeds the limiting value resulting from compressing the spring 18 and from its lever arm with respect to the tilting spindle 19. Indeed, the end of the lever 16 then moves away from the switch 21, the pulley 4 is lowered to 4*a* and the lever 16 tilts into the position 16*a*. The electric circuit of which the switch 21 forms a part automatically commands the reversal of the direction of rotation of the motor of the motorised reduction gear 2.

The invention is not limited to the embodiments described and may include various variant embodiments. Generally, the invention covers all means equivalent to those described, that is to say which can carry out a weighing on the cable of the force on the window. Indeed, force is transmitted to the cable 3 via the carriage 7, so that the force on the cable gives a good image of the force on the window.

We claim:

1. In a safety device for vehicle electric window lifters of the cable type having an electric motor fixedly mounted to a door panel, said electric motor drivingly connected to said cable, a return pulley for said cable, a carriage fixed to said cable, said carriage carrying a window, and electromechanical means for reversing direction of rotation of said electric motor when said window encounters a force exceeding a predetermined value opposing said travel of said window, the improvement comprising:

a predetermined compression spring having a return force, said spring interposed between a stationary support fixed to said door panel and an element moveable by said cable counter to said return force of said compression spring, said moveable element interacting with an electrical switch forming part of the electrical supply circuit for said electric motor, said electric switch assuming a first state when said force does not exceed said predetermined value and assuming a second state when said force exceeds said predetermined value, said electric motor reversing direction when said switch changes state, wherein said moveable element comprises a tubular member surrounding said cable, and wherein said spring has a first end near said stationary support and a second end opposite said first end, said tubular element having an end which bears against said spring along said second end of said spring, said tubular element further having a protruding element which interacts with said switch.

2. A device according to claim 1, comprising:

a) a sheath coaxial with said cable, b) a helical spring having two ends, said helical spring surrounding said cable and capable of sliding with said sheath, said first end being secured to said stationary support;

c) said moveable element capable of sliding within said sheath; and d) said protruding element comprising a lateral tab borne on said tubular element, said lateral tab interacting with said switch.

3. A device according to claim 2, wherein said sheath is secured to said stationary support for said helical spring.

4. A device according to claim 3, wherein said stationary support is a plate on which said return pulley is mounted.

* * * * *